US009764326B2

(12) United States Patent
Dricken et al.

(10) Patent No.: US 9,764,326 B2
(45) Date of Patent: Sep. 19, 2017

(54) APPARATUS AND METHOD FOR AN ANTI-SPIN SYSTEM

(71) Applicant: Telsmith, Inc., Mequon, WI (US)

(72) Inventors: Chuck Dricken, Kewaskum, WI (US); Sean Neitzel, Kronenwetter, WI (US); Dean Wolfe, West Bend, WI (US); Matthew Haven, Cedarburg, WI (US); Albert Van Mullem, Sussex, WI (US)

(73) Assignee: Telsmith, Inc., Mequon, WI (US)

( * ) Notice: Subject to any disclaimer, the term of this patent is extended or adjusted under 35 U.S.C. 154(b) by 388 days.

(21) Appl. No.: 14/349,752

(22) PCT Filed: Oct. 5, 2012

(86) PCT No.: PCT/US2012/058940

§ 371 (c)(1),
(2) Date: Apr. 4, 2014

(87) PCT Pub. No.: WO2013/052792

PCT Pub. Date: Apr. 11, 2013

(65) Prior Publication Data

US 2014/0239102 A1 Aug. 28, 2014

Related U.S. Application Data

(60) Provisional application No. 61/626,967, filed on Oct. 6, 2011.

(51) Int. Cl.

| | |
|---|---|
| ***B02C 2/00*** | (2006.01) |
| ***B02C 2/04*** | (2006.01) |
| ***B02C 25/00*** | (2006.01) |

(52) U.S. Cl.
CPC ..... *B02C 2/047* (2013.01); *B02C 2/04* (2013.01); *B02C 25/00* (2013.01); *B02C 2/00* (2013.01)

(58) Field of Classification Search
CPC ..... B02C 2/00; B02C 2/047; B02C 25/00
(Continued)

(56) References Cited

U.S. PATENT DOCUMENTS 4,232,833 A * 11/1980 Werginz ..... B02C 2/047 241/207
4,467,971 A * 8/1984 Schuman ..... B02C 2/047 241/215

(Continued)

*Primary Examiner* — Faye Francis
(74) *Attorney, Agent, or Firm* — Chambliss, Bahner & Stophel, P.C.

(57) ABSTRACT

An anti-spin system adapted for use on a rock crusher having stationary frame, a crushing head, a crushing head pivot point, a shaft, bearings, a crushing chamber, crushing chamber liners and working fluid. The preferred anti-spin system includes a flow source which is adapted to provide working fluid flow, a working fluid source which is adapted to supply working fluid, a control valve which is in fluid communication with the working fluid source and being adapted to allow the working fluid to flow to the flow source, and a torque transmittal assembly which is adapted to connect the crushing head and the flow source and transmit torque from the crushing head to the stationary frame. The preferred anti-spin system is adapted to control rotation of the crushing head. A method comprising providing such an anti-spin system and controlling the rotation of the crushing head.

18 Claims, 10 Drawing Sheets

(58) Field of Classification Search
USPC ..... 241/207–216, 36, 35
See application file for complete search history.

(56) References Cited

U.S. PATENT DOCUMENTS

| | | | | | |
|---|---|---|---|---|---|
| 4,666,092 | A * | 5/1987 | Bremer | B02C 2/047 | 241/214 |
| 5,732,896 | A * | 3/1998 | Jakob | B02C 2/047 | 241/215 |
| 5,931,394 | A * | 8/1999 | Haven | B02C 2/047 | 241/215 |
| 7,048,214 | B2 * | 5/2006 | Johnson | B02C 2/00 | 241/207 |
| 2004/0035967 | A1 * | 2/2004 | Johnson | B02C 2/00 | 241/207 |

* cited by examiner

APPARATUS AND METHOD FOR AN ANTI-SPIN SYSTEM

CROSS-REFERENCES TO RELATED APPLICATIONS/PATENTS

This application relates back to and claims priority from U.S. Provisional Application for Patent No. 61/626,967 titled "Anti-Spin System" and dated Oct. 6, 2011.

FIELD OF THE INVENTION

The present invention relates generally to anti-spin systems adapted for use in rock crushers, and particularly to anti-spin systems adapted for use on gyratory cone crushers.

BACKGROUND AND DESCRIPTION OF THE PRIOR ART

It is known to use anti-spin devices on rock crushers to prevent unwanted rotation of the crushing head when the crusher is idling, i.e. running but not crushing rocks. Conventional anti-spin devices, however, suffer from one or more disadvantages. For example, conventional anti-spin devices are expensive. Conventional anti-spin devices also are undesirably large and located beneath the crusher. In addition, conventional anti-spin devices are difficult to maintain, repair and replace. Conventional anti-spin devices are also susceptible to fluid cross-contamination.

It would be desirable, therefore, if an apparatus and method for an anti-spin system could be provided that would reduce the cost of the rock crusher anti-spin system. It would also be desirable if such an apparatus and method could be provided that would reduce the size of the rock crusher at system and locate it near the crushing head pivot point. It would be further desirable if such an apparatus and method could be provided that would simplify the maintenance, repair and replacement of the anti-spin system. It would be further desirable if such an apparatus and method could be provided that would eliminate the risk of fluid cross-contamination.

ADVANTAGES OF THE PREFERRED EMBODIMENTS OF THE INVENTION

Accordingly, it is an advantage of the preferred embodiments of the invention claimed herein to provide an apparatus and method for an anti-spin system that reduces the cost of the rock crusher anti-spin system. It is also an advantage of the preferred embodiments of the invention claimed herein to provide an apparatus and method for an anti-spin system that reduces the size of the rock crusher anti-spin system and locates it near the crushing head pivot point. It is a further advantage of the preferred embodiments of the invention claimed herein to provide an apparatus and method for an anti-spin system that simplifies the maintenance, repair and replacement of the anti-spin system. It is a still-further advantage of the preferred embodiments of the invention claimed herein to provide an apparatus and method for an anti-spin system that eliminates the risk of fluid cross-contamination.

Additional advantages of the preferred embodiments of the invention will become apparent from an examination of the drawings and the ensuing description.

SUMMARY OF THE INVENTION

The apparatus of the invention comprises an anti-spin system adapted for use on a rock crusher having stationary frame, a crushing head, a crushing head pivot point, a shaft, bearings, a crushing chamber, crushing chamber liners and working fluid. The preferred anti-spin system comprises a flow source which is adapted to provide working fluid flow, a working fluid source which is adapted to supply working fluid, a control valve which is in fluid communication with the working fluid source and being adapted to allow the working fluid to flow to the flow source, and a torque transmittal assembly which is adapted to connect the crushing head and the flow source and transmit torque from the crushing head to the stationary frame. The preferred anti-spin system is adapted to control rotation of the crushing head.

The method of the invention comprises providing an anti-spin system adapted for use on a rock crusher having stationary frame, a crushing head, a crushing head pivot point, a shaft, bearings, a crushing chamber, crushing chamber liners and working fluid. The preferred anti-spin system comprises a flow source which is adapted to provide working fluid flow, a working fluid source which is adapted to supply working fluid, a control valve which is in fluid communication with the working fluid source and being adapted to allow the working fluid to flow to the flow source, and a torque transmittal assembly which is adapted to connect the crushing head and the flow source and transmit torque from the crushing head to the stationary frame. The preferred anti-spin system is adapted to control rotation of the crushing head. The preferred method further comprises controlling the rotation of the crushing head.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
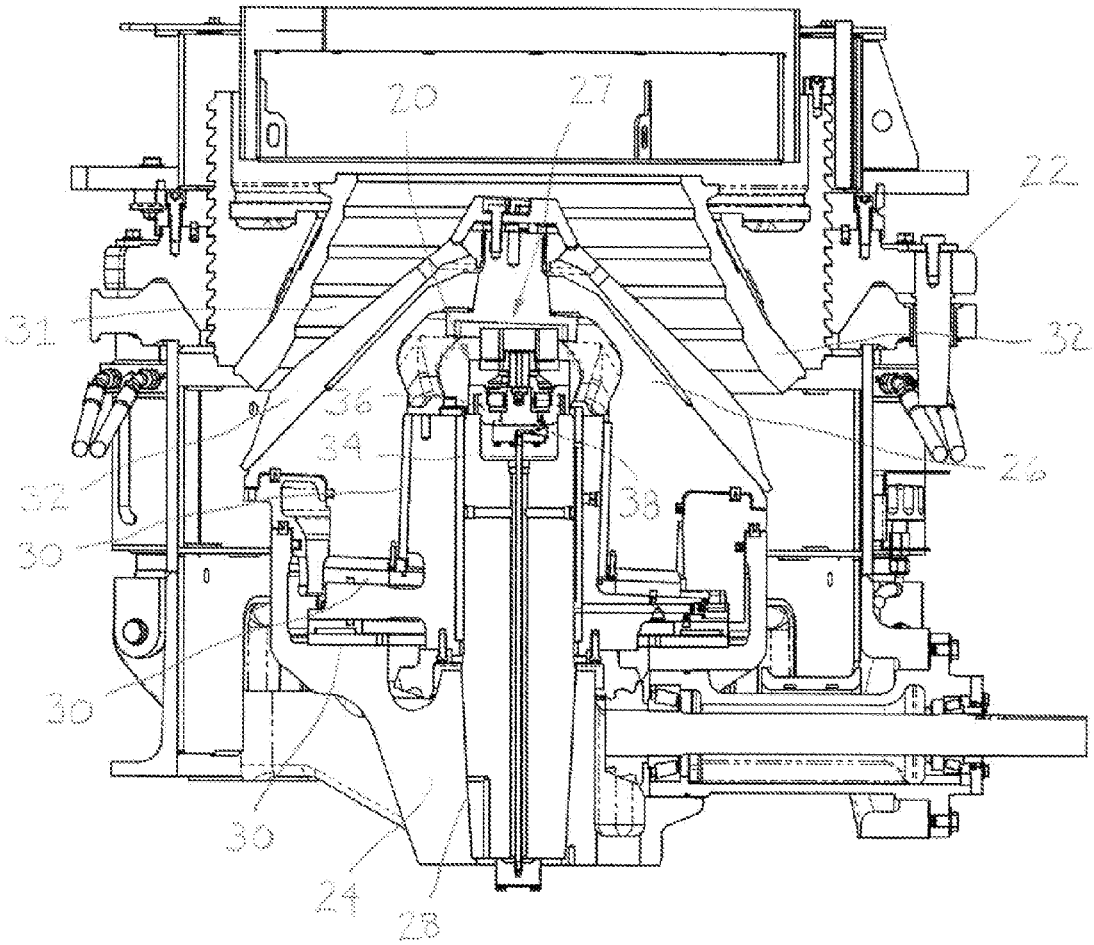
FIG. 1 is a sectional front view of an exemplary gyratory cone crusher including the preferred embodiment of the anti-spin system in accordance with the present invention.

Referring now to the drawings, the preferred embodiment of the anti-spin system in accordance with the present invention is illustrated by FIGS. 1 through 8. As shown in FIGS. 1-8, the preferred embodiments of the anti-spin system in accordance with the present invention are adapted to reduce the cost of a rock crusher anti-spin system. The preferred embodiments of the anti-spin system are also adapted to reduce the size of the rock crusher anti-spin system and locate it near the crushing head pivot point. The preferred embodiments of the anti-spin system are further adapted to simplify the maintenance, repair and replacement of the anti-spin system. The preferred embodiments of the anti-spin system are still further adapted to eliminate the risk of fluid cross-contamination.

Referring now to FIG. 1, a sectional front view of an exemplary .gyratory cone crusher including the preferred embodiment of the anti-spin system in accordance with the present invention is illustrated. As shown in FIG. 1, the preferred anti-spin system is designated generally by reference numeral 20. Preferred anti-spin system 20 is adapted for use on exemplary rock crusher 22 which includes stationary frame 24, crushing head 26, crushing head pivot point 27, shall 28, bearings 30, crushing chamber 31, crushing chamber liners 32 and a working fluid. Preferred anti-spin system 20 is disposed adjacent to crushing head pivot point 27 and is adapted to function on any axis of crushing head rotation. The primary function of preferred crushing head 26 is to transmit the input power from rock crusher 22 to rocks through gyrating motion. The entire head gyrates about the hydraulic motor axis, and also spins on its own axis. When the rock crusher 22 is idling (gyrating but not crushing), crushing head 26 will tend to rotate on its axis at high speed (with its mating part) as a result of bearing friction. When rock crusher 22 is crushing, crushing head 26 will rotate slowly in the opposite direction (on its axis) as a result of the crushing action. The high speed rotation causes problems in the bearing systems (e.g. increased friction and wear) and will accelerate wear on crushing chamber liners 32 when neck is introduced as the preferred system transitions from idling to crushing.

Still referring to FIG. 1, preferred anti-spin system 20 comprises a working fluid source such as reservoir 34 which is adapted to provide working fluid to a flow source such as radial piston motor 36. Preferably, reservoir 34 is disposed below radial piston motor 36 and is in fluid communication with the radial piston motor. Preferred control valve, such as cheek valve 38, may be disposed in radial piston motor 36 or in an external manifold that is connected to the radial piston motor. The preferred reservoir 34 is filled with crusher lubrication oil either by a direct pressurized source or filled at atmospheric pressure such as a sump that would catch unpressurized oil. The preferred open design of reservoir 34 allows for free flow of flushing oil (either pressurized or non-pressurized) to help cool the system and remove contaminants from the system. The ability to flush the preferred embodiments of anti-spin system 20 improves the reliability of system components (e.g., valve sticking, premature wear, etc.). Further, the preferred anti-spin system 20 is adapted to use crusher lubrication oil thereby eliminating the risk of crusher fluid cross-contamination which could occur if the system used dissimilar working fluid such as hydraulic oil, gear oil, synthetic oil, water and the like. Still further, the preferred anti-spin system 20 is adapted to use crusher lubrication oil or any other type of working fluid such as hydraulic oil, gear oil, synthetic oil, water and the like.

Still referring to FIG. 1, preferred radial piston motor 36 is disposed inside rock crusher 22, but it is contemplated within the scope of the invention that the motor may be disposed on the exterior of the crusher or remote from the crusher. Preferred radial piston motor 36 is adapted to provide working fluid flow and together with check valve 38 restrict the undesirable rotation of crushing head 26. More particularly, preferred radial piston motor 36 is adapted to tolerate the flows at both normal head rotational speed and also "locked" eccentric speeds. "Locked" eccentric speed takes place when crushing head 26 becomes stuck on eccentric 28 and may occur when debris enters the crusher, one or more parts are damaged or a bearing fails. Further, preferred radial piston motor 36 is adapted to retard crushing head 26 from spinning. Preferably, radial piston motor 36 is compact so as to reduce the overall height of rock crusher 22 and is adapted to tolerate a variety of working fluids.

In operation, the torque transmitted from crushing head 26 to preferred radial piston motor 36 during idling will cause working fluid to be pumped against check valve 38 causing a rise in pressure that will counteract (restrain/retard) rotation of crushing head 26. Internal leakage (inefficiency) in radial piston motor 36 and valves may result in very slow, but acceptable crushing head rotation during idling. The preferred radial piston motor 36 also allows for free rotation of crushing head 26 during crushing operations. Preferably, as a result of the crushing action, crushing head 26 rotates (e.g., counterclockwise) in the opposite direction of the idle direction of rotation (e.g., clockwise) which causes radial piston motor 36 to pump fluid toward check valve 38 so as to flow freely past the check valve, thereby allowing free rotation of the crushing head. Preferred check valve 38 is spaced apart from crushing head 26. While radial piston motor 36 is the preferred flow source, it is contemplated within the scope of the invention that the flow source may be a hydraulic motor, hydraulic pump or any other suitable device, mechanism, assembly or combination thereof adapted to provide working fluid flow.

Still referring to FIG. 1, in the preferred embodiments of anti-spin system 20, the system is adapted to control the rotation of crushing head 26, particularly during idle periods. The preferred embodiments of anti-spin system 20 are also adapted to maintain the relative velocity difference between the adjacent bearing parts and preserve hydrodynamic separation of bearings 30. The preferred embodiments of anti-spin system 20 are further adapted to reduce wear on crushing chamber liners 32 and reduce rock shear within crushing chamber 31. Preferred anti-spin system 20 is still further adapted to reduce the dimensional ratio of elongated rock particles discharged from rock crusher 22 otherwise caused by excessive bead rotation and permit rock crusher 22 to operate with a single working fluid. While FIG. 1 illustrates the preferred configuration and arrangement of the anti-spin system, it is contemplated within the scope of the invention that the anti-spin system may be of any suitable configuration and arrangement.

Figure 2:
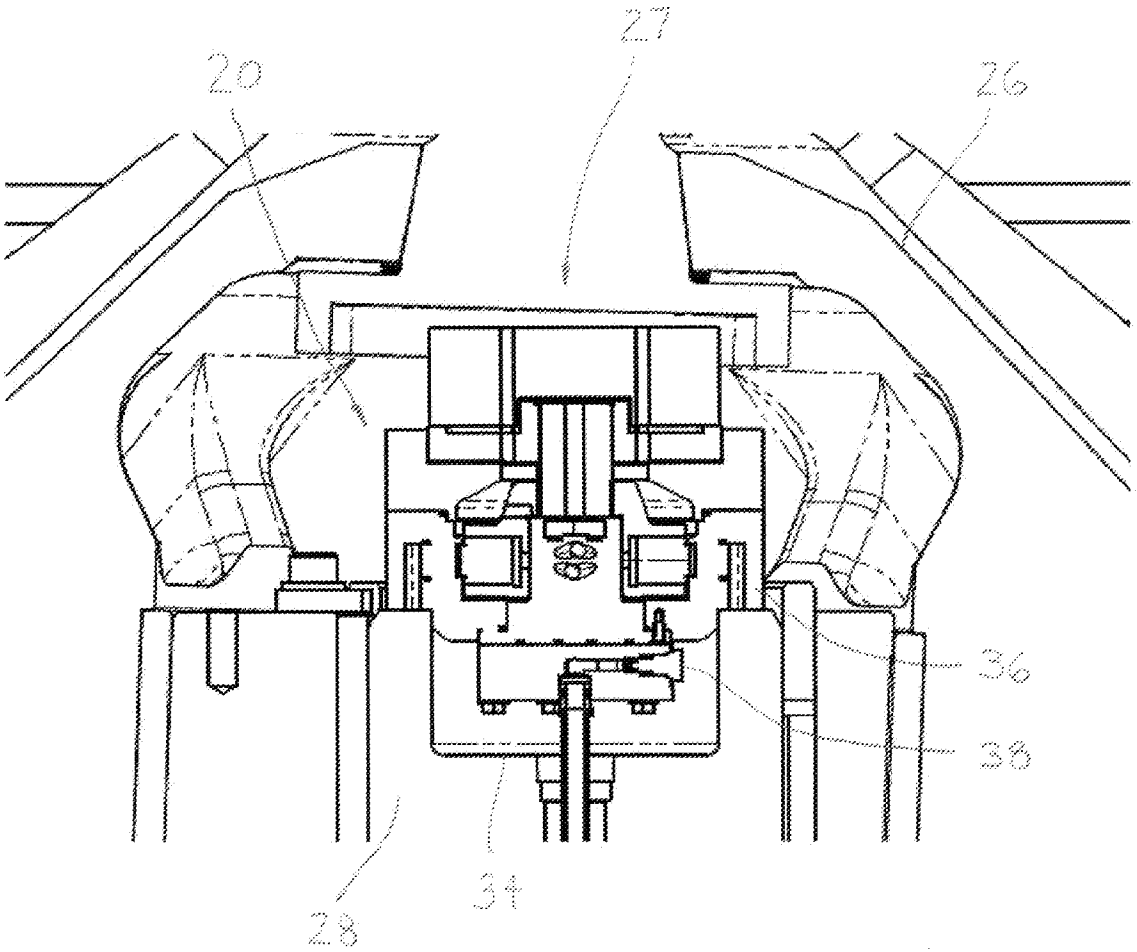
FIG. 2 is a sectional front view of the preferred anti-spin system illustrated in FIG. 1.

Referring now to FIG. 2, a sectional front view of preferred anti-spin system 20 is illustrated. As shown in FIG. 2, preferred anti-spin system 20 comprises crushing head 26, crushing head pivot point 27, shaft 28, reservoir 34, radial piston motor 36 and check valve 38.

Figure 3:
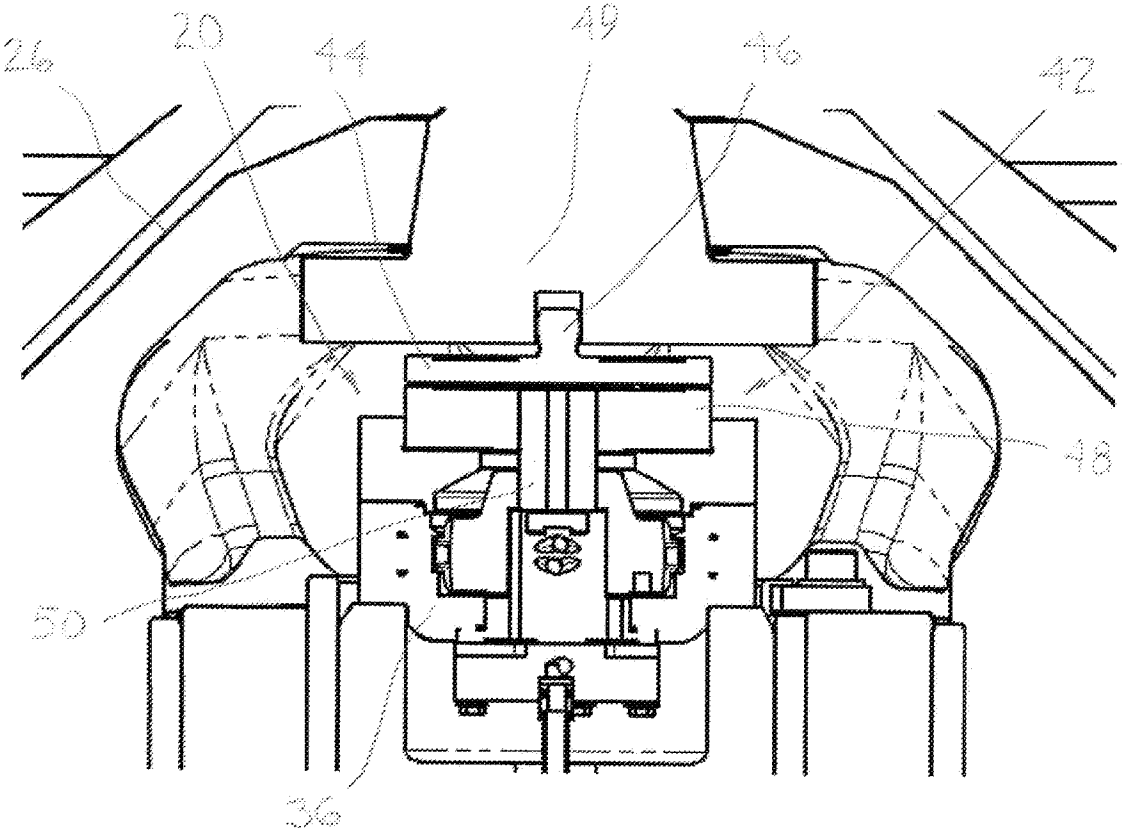
FIG. 3 is a sectional right side view of the preferred anti-spin system illustrated in FIGS. 1-2.

Referring now to FIG. 3, a sectional right side view of preferred anti-spin system 20 is illustrated. As shown in FIG. 3, preferred anti-spin system 20 further comprises torque transmittal assembly 42 which is adapted to connect crushing head 26 to the flow source such as radial piston motor 36 and transmit torque from the crushing head to stationary frame 24. The preferred torque transmittal assembly 42 also permits crushing head 26 to gyrate and rotate while transmitting torque from the crushing head to radial piston motor 36. Preferred torque transmittal assembly 42 comprises slider plate 44 which is adapted to engage crushing head 26. Preferred slider plate 44 includes tang 46. Preferred torque transmittal assembly 42 also comprises torque adapter 48 which is disposed adjacent to slider plate 44 and anti-spin shaft 50. Preferably, slider plate 44, torque adapter 48 and head shaft 49 form an Oldham Coupling which is used to couple misaligned parallel shafting. While FIG. 3 illustrates the configuration and arrangement of the preferred torque transmittal assembly, it is contemplated within the scope of the invention that the torque transmittal assembly may be of any suitable configuration and arrangement.

Figure 4:
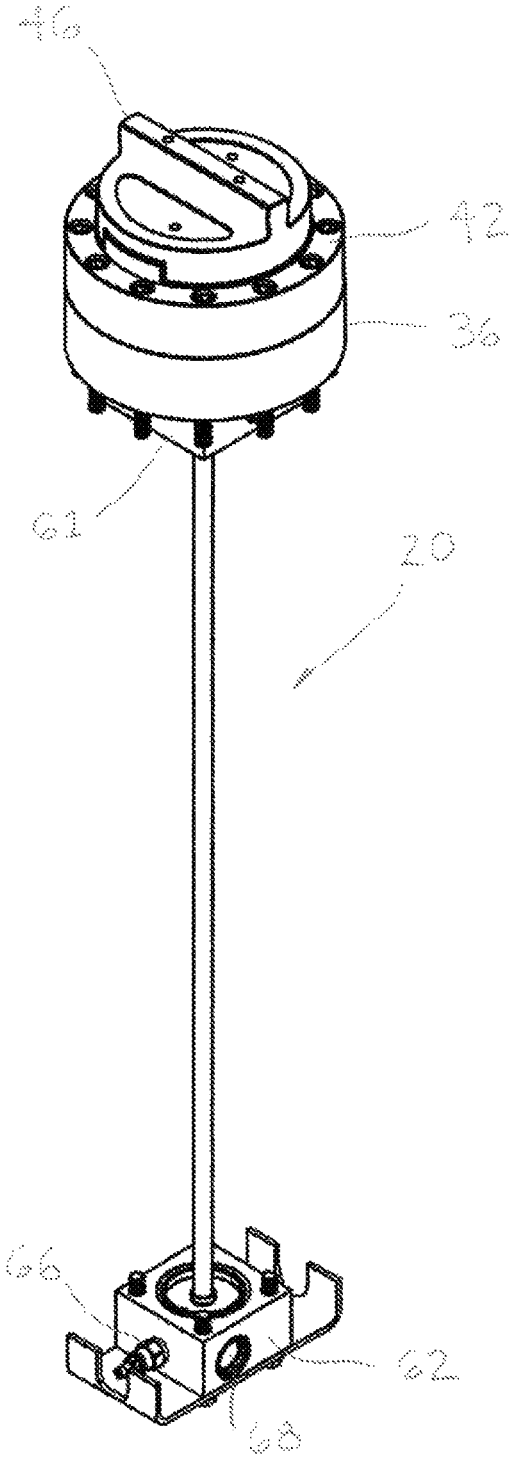
FIG. 4 is a perspective view of the preferred anti-spin system illustrated in FIGS. 1-3.

Referring now to FIG. 4, a perspective view of anti-spin system 20 is illustrated. The preferred anti-spin system 20 comprises check valve manifold 61, radial piston motor 36, torque transmittal assembly 42 and tang 46. In addition, preferred anti-spin system 20 comprises remote hydraulic manifold 62, and safety valve 66. Preferred safety valve 66 is adapted to open when a predetermined maximum working fluid pressure level is reached so as to protect the hydraulic and mechanical components from overload. More particularly, when the restraining pressure exceeds a predetermined value, the fluid will cause preferred safety valve 66 to open, thereby allowing for free rotation of the crushing head and protecting against damage to the system. Preferred safety valve 66 is also adapted to automatically reset when a predetermined safe working fluid pressure level is achieved after the safety valve has opened. Preferred safety valve 66 may be mounted either on radial piston motor 36 or remote from the radial piston motor. It is contemplated within the scope of the invention, however, that preferred anti-spin system 20 could be operated without a safety valve.

Still referring to FIG. 4, preferred anti-spin system 20 further comprises transducer 68 which is adapted to sense working fluid pressure in the anti-spin system. Preferred transducer 68 is adapted to provide information regarding the condition of rock crusher 22 providing options for automation of the rock crusher and assistance with diagnosing problems. It is contemplated within the scope of the invention, however, that preferred anti-spin system 20 could be operated without a transducer.

Figure 5:
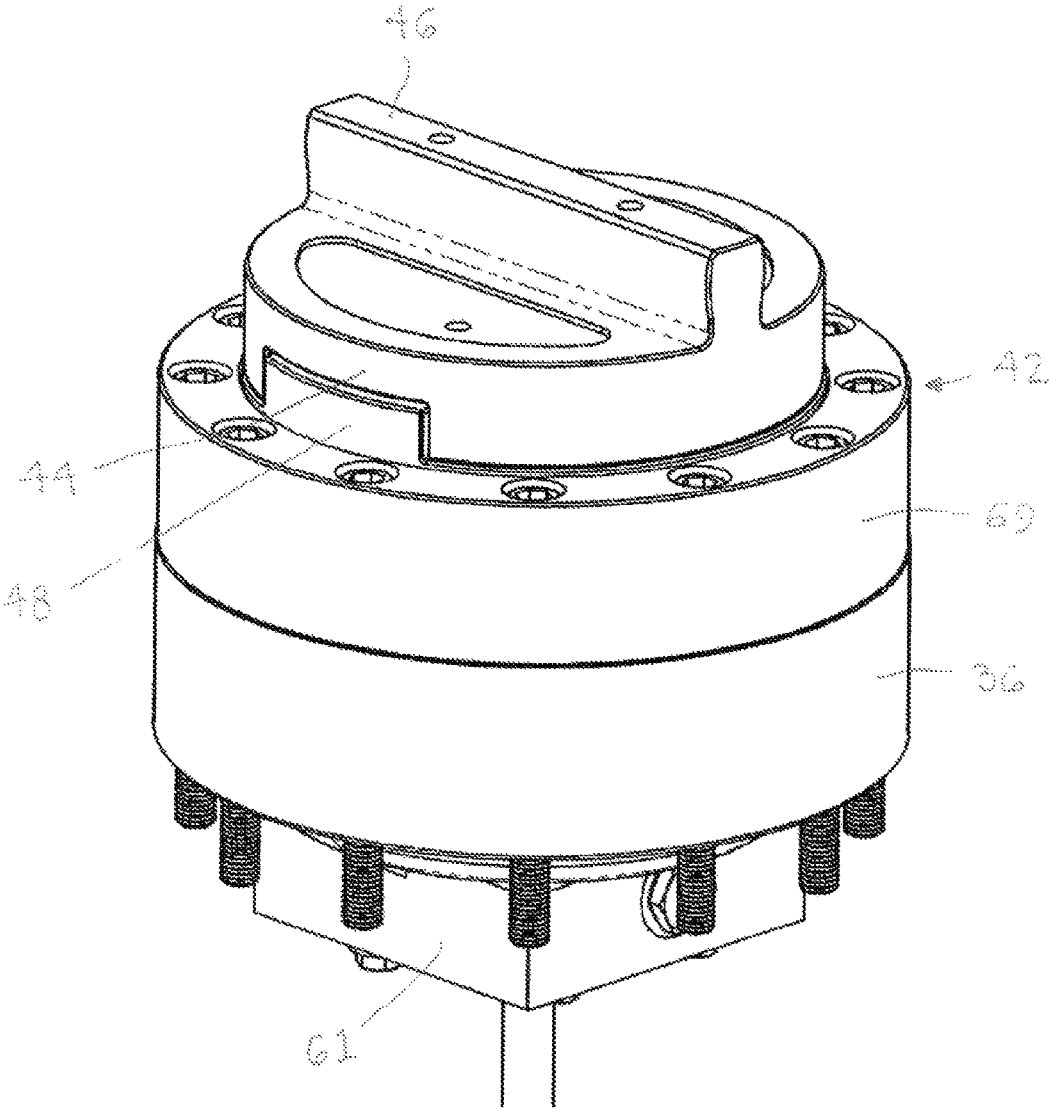
FIG. 5 is a perspective view of upper portion of the preferred anti-spin system illustrated in FIGS. 1-4.

Referring now to FIG. 5, a perspective view of the upper portion of preferred anti-spin system 20 of preferred anti-spin system 20 is illustrated. As shown in FIG. 5, the upper portion of preferred anti-spin system 20 comprises radial piston motor 36, torque transmittal assembly 42, slider plate 44, tang 46, torque adapter 48 and check valve manifold 61.

Figure 6:
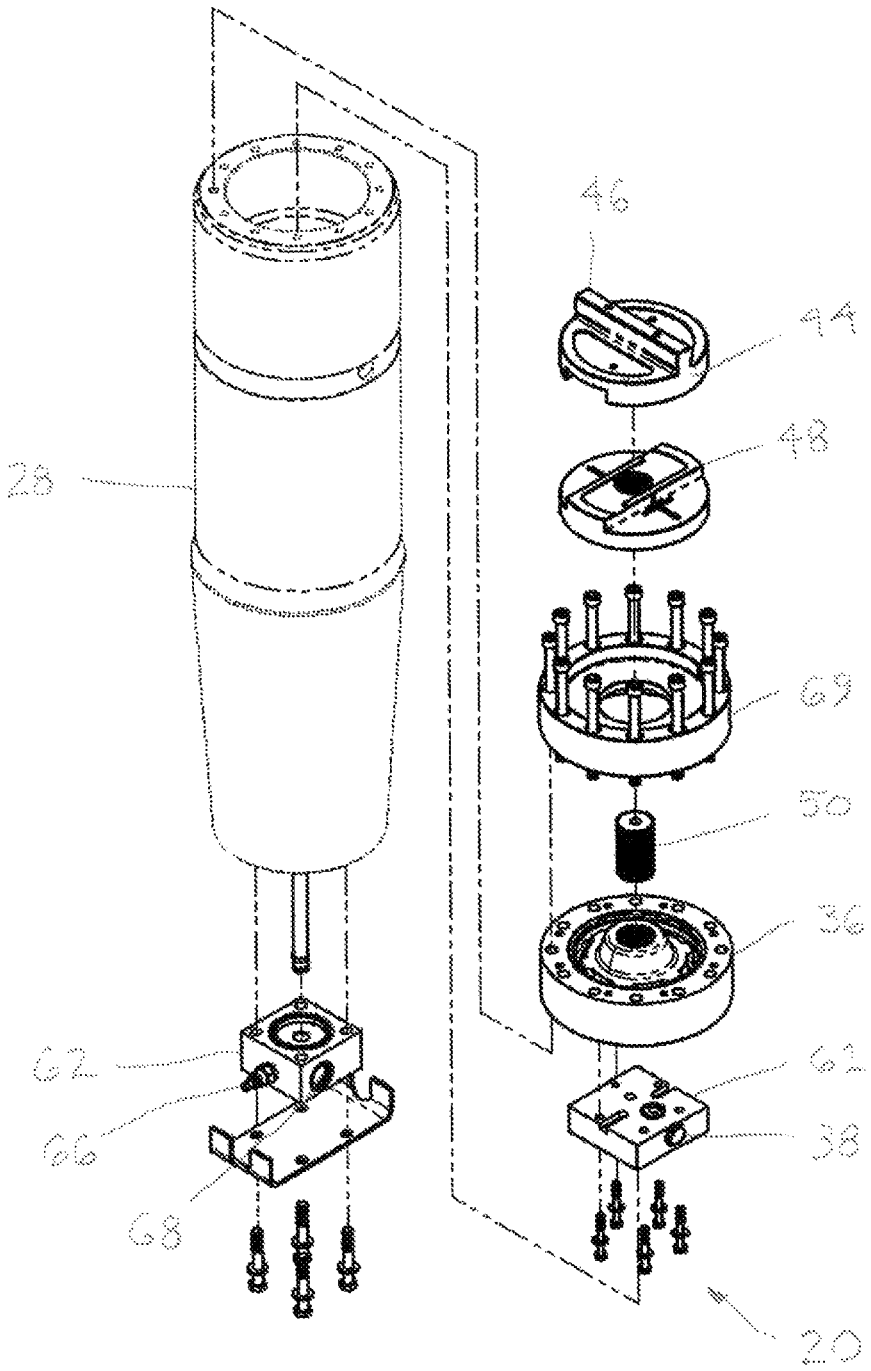
FIG. 6 is an exploded perspective view of the preferred anti-spin system illustrated in FIGS. 1-5.

Referring now to FIG. 6, an exploded perspective view of preferred anti-spin system 20 is illustrated. As shown in FIG. 6, preferred anti-spin system 20 comprises radial piston motor 36, check valve 38, slider plate 44, tang 46, torque adapter 48 and bearing plate 69 disposed at one end of shaft 28. Preferred anti-spin system 20 also comprises remote hydraulic manifold 62, safety valve 66 and transducer 68 disposed at the opposite end of shaft 28.

Figure 7:
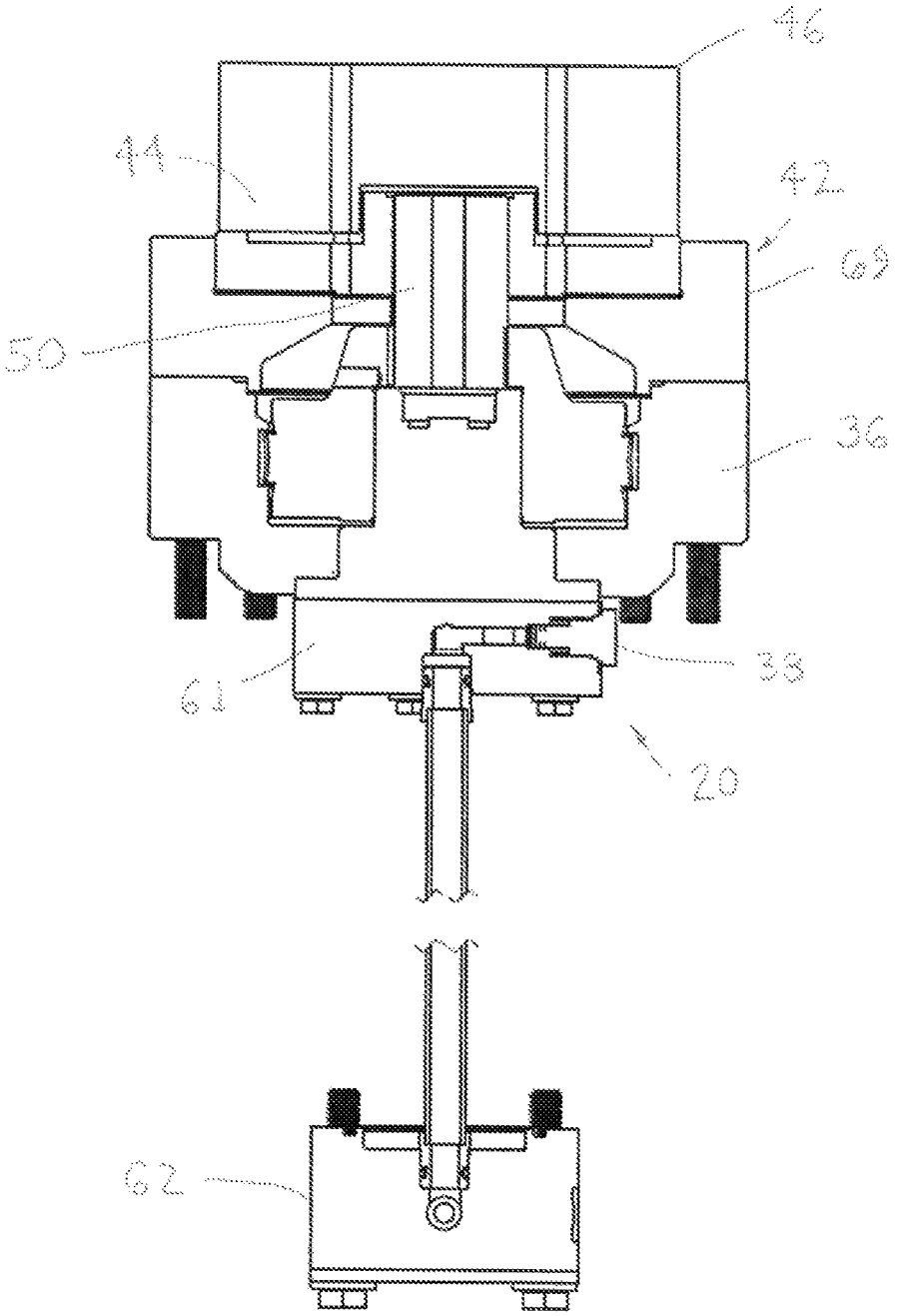
FIG. 7 is a sectional view of the preferred anti-spin system illustrated in FIGS. 1-6.

Referring now to FIG. 7, a sectional view of preferred anti-spin system 20 is illustrated. As shown in FIG. 7, preferred anti-spin system 20 comprises radial piston motor 36, check valve 38, torque transmittal assembly 42, slider plate 44, tang 46, torque adapter 48, anti-spin shaft 50. In addition, preferred anti-spin system 20 comprises remote check valve manifold 61, hydraulic manifold 62 and bearing plate 69.

Figure 8:
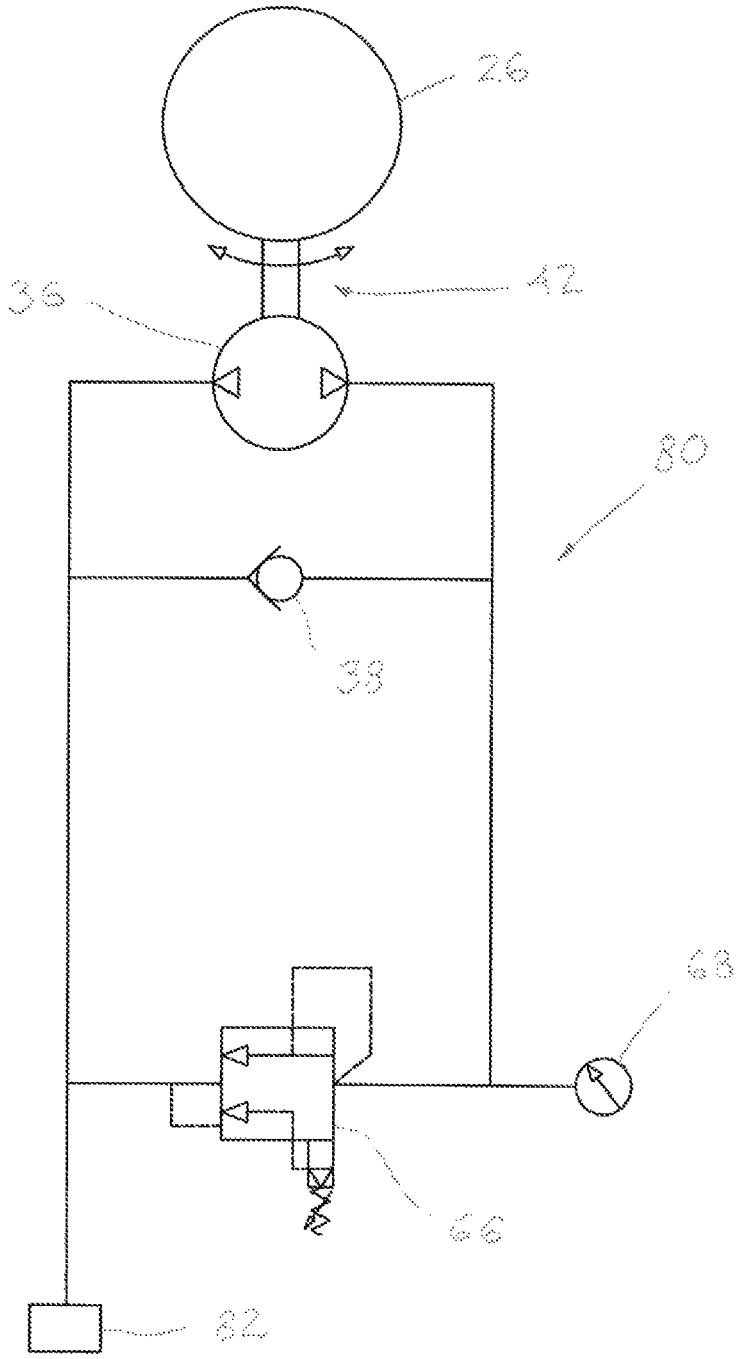
FIG. 8 is a schematic of the preferred anti-spin system illustrated in FIGS. 1-7.

Referring now to FIG. 8, a schematic view of preferred anti-spin system 20 is illustrated. As shown in FIG. 8, the preferred anti-spin system circuit is designated generally by reference numeral 80. Preferred anti-spin system circuit 80 includes crushing head 26 radial piston motor 36, check valve 38, toque transmittal assembly 42, safety valve 66, transducer 68 and working fluid source 82. Preferred anti-spin system circuit 80 eliminates the need for speed changes via gear sets or torque reduction from the crushing head 26. Preferred circuit 80 is tolerant of a wide range of input speeds without loss of hydraulic efficiency (which translates into restraining speed). Preferred circuit 80 is adapted to use the same working fluid as other crusher lubrication fluid in rock crusher 22, thus eliminating the risk of cross-contamination and reducing costs.

Preferred circuit 80 is simpler, less costly and more compact than conventional circuits. As a result, preferred circuit 80 may be mounted close to crushing head pivot point 27 which reduces wear on rock crusher 22.

Figure 9:
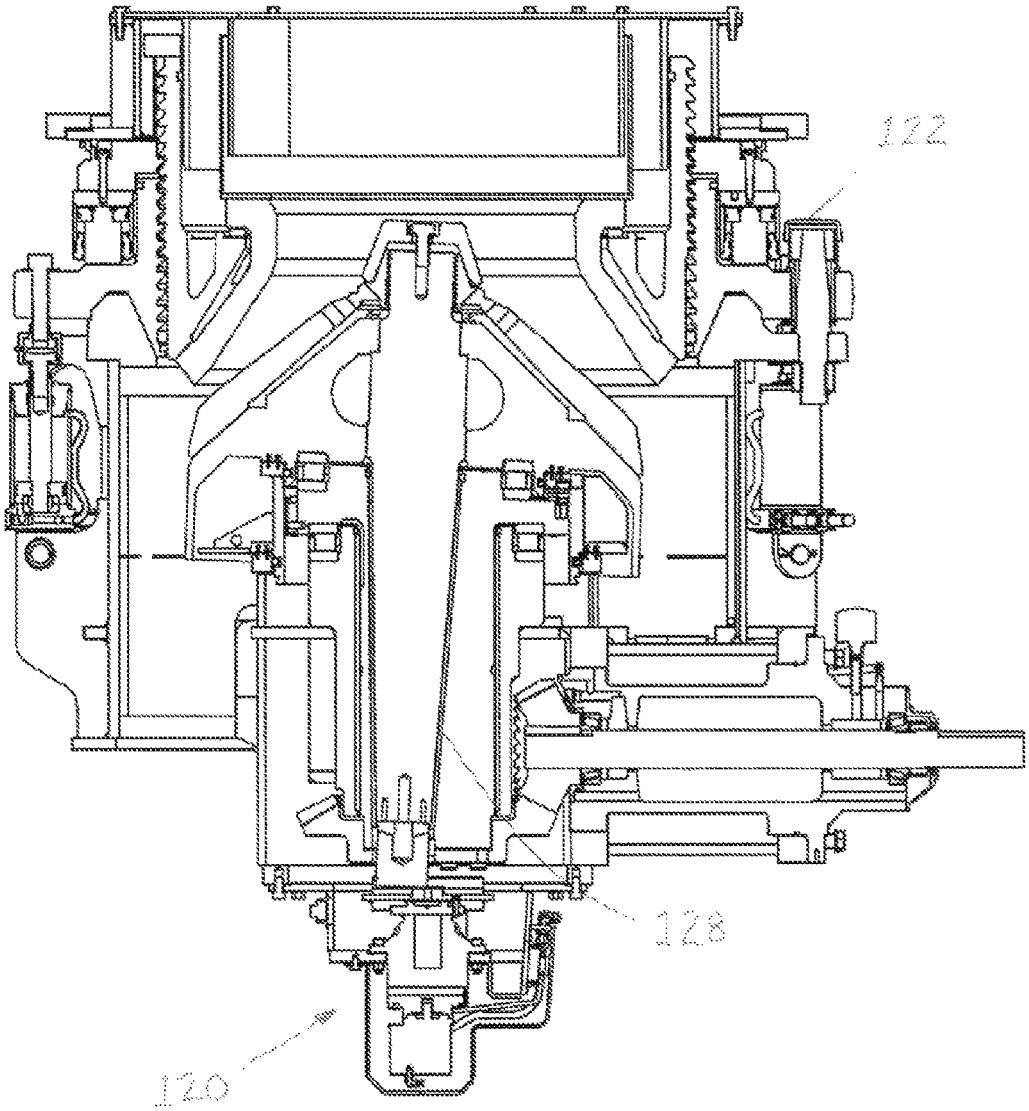
FIG. 9 is a sectional front view of an exemplary gyratory cone crusher including a prior art anti-spin system.

Referring now to FIG. 9, a sectional front view of an exemplary gyratory cone crusher including a prior art anti-spin system is illustrated. As shown in FIG. 9, prior art anti-spin system is designated generally by reference numeral 120. Prior art anti-spin system 120 is adapted for use on rock crusher 122 and is disposed below shall 128. As a result, prior art anti-spin system 120 undesirably adds to the overall height of rock crusher 122.

Figure 10:
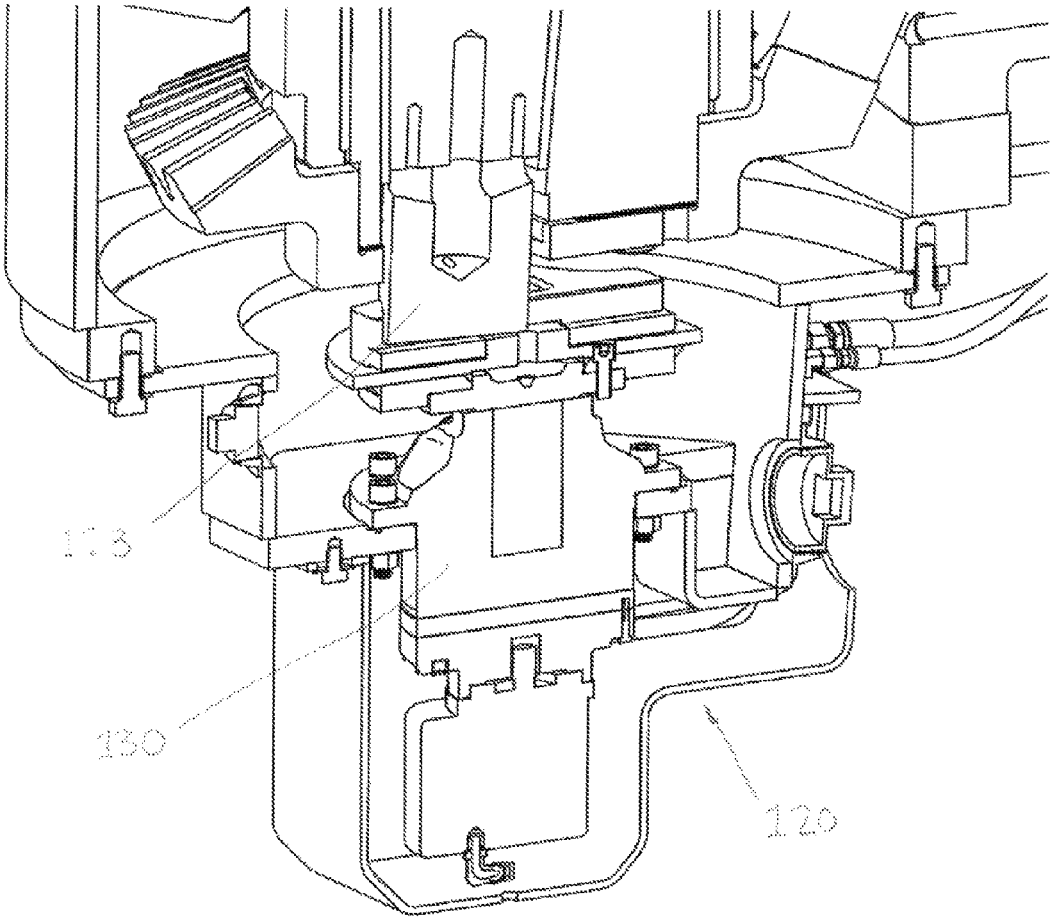
FIG. 10 is a perspective view of the prior art anti-spin device illustrated in FIG. 9.

FIG. 10 is a sectional perspective view of prior art anti-spin device 120 illustrated in FIG. 9. As shown in FIG. 10, prior art anti-spin device 120 is disposed below shaft 128. In addition, prior art anti-spin device 120 includes gearbox 130.

The preferred embodiments of the invention also comprise a method for controlling crusher head rotation. The preferred method for minimizing crushing head rotation comprises providing an anti-spin system as described herein. More particularly, the preferred anti-spin system comprises an anti-spin system adapted for use on a rock crusher having stationary frame, a crushing head, a crushing head pivot point, a shaft, bearings, a crushing chamber, crushing chamber liners and working fluid. The preferred anti-spin system comprises a flow source which is adapted to provide working fluid flow, a working fluid source which is adapted to supply working fluid, a control valve which is in fluid communication with the working fluid source and being adapted to allow the working fluid to flow to the flow source, and a torque transmittal assembly which is adapted to connect the crushing head and the flow source and transmit torque from the crushing head to the stationary frame. The preferred anti-spin system is adapted to control rotation of the crushing head. The preferred method for controlling crashing bead rotation also comprises controlling the rotation of the crashing head.

In operation, several advantages of the preferred embodiments of the invention are achieved. For example, the preferred embodiments of the anti-spin system in accordance with the present invention are adapted to reduce the cost of a rock crusher anti-spin system. The preferred embodiments of the anti-spin system are also adapted to reduce the size of the rock crusher anti-spin system and be located near the crushing head pivot point. The preferred embodiments of the anti-spin system are further adapted to simplify the maintenance, repair and replacement of the anti-spin system. The preferred embodiments of the anti-spin system are still further adapted to eliminate the risk of fluid cross-contamination.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A rock crusher having a stationary frame, a crushing head, a crushing head pivot point, a shaft, one or more pairs of adjacent bearings, a crushing chamber, crushing chamber liners, a working fluid, and an anti-spin system, said anti-spin system comprising:

(a) a working fluid source, said working fluid source being configured to supply the working fluid to the anti-spin system and the rock crusher;

(b) a control valve, said control valve being in fluid communication with the working fluid source;

(c) a torque transmittal assembly, said torque transmittal assembly being configured to transmit torque from the crushing head to the stationary frame, and said torque transmittal assembly being disposed between the crushing head and the shaft, and said torque transmittal assembly having:

(i) a slider plate, said slider plate being disposed adjacent to the crushing head, and said slider plate having a tang;

(ii) a torque adapter, said torque adapter being disposed adjacent to the slider plate;

(iii) a radial piston motor, said radial piston motor being disposed adjacent to the torque adapter, and said radial piston motor being configured to provide working fluid flow to the anti-spin system;

wherein the anti-spin system is configured to control rotation of the crushing head; and wherein the control valve is configured to allow the working fluid to flow to the radial piston motor; and wherein the torque transmittal assembly is configured to connect the crushing head and the radial piston motor.

2. The anti-spin system of claim 1 wherein the anti-spin system is configured to prevent rotation of the crushing head during idle periods.

3. The anti-spin system of claim 1 wherein the anti-spin system is configured to hydrodynamically separate the one or more pairs of adjacent bearings.

4. The anti-spin system of claim 1 wherein the anti-spin system is configured to reduce wear on the crushing chamber liners.

5. The anti-spin system of claim 1 wherein the anti-spin system is configured to reduce rock shear within the crushing chamber.

6. The anti-spin system of claim 1 wherein the anti-spin system is configured to reduce the dimensional ratio of elongated rock particles discharged from the crusher.

7. The anti-spin system of claim 1 wherein the anti-spin system is disposed adjacent to a crushing head pivot point.

8. The anti-spin system of claim 1 wherein the rock crusher comprises crusher lubrication oil.

9. The anti-spin system of claim 1 wherein the working fluid source comprises a reservoir.

10. The anti-spin system of claim 1 further comprising a safety valve that is configured to open when a predetermined maximum working fluid pressure level is reached.

11. The anti-spin system of claim 1 further comprising a safety valve that is configured to automatically reset when a predetermined safe working fluid pressure level is achieved after said safety valve has opened.

12. The anti-spin system of claim 1 further comprising a transducer configured to sense working fluid pressure in the anti-spin system.

13. The anti-spin system of claim 1 further comprising a remote hydraulic manifold including a remote control valve.

14. The anti-spin system of claim 1 wherein the control valve is spaced apart from the crushing head.

15. The anti-spin system of claim 1 wherein the slider plate is configured to engage the crushing head.

16. The anti-spin system of claim 15 wherein the tang is configured to engage a slot in the crushing head.

17. The anti-spin system of claim 1 wherein the torque transmittal assembly comprises an anti-spin shaft, said anti-spin shaft being disposed adjacent to the torque adapter.

18. A method for controlling crushing head rotation, said method comprising:

(a) providing a rock crusher having a stationary frame, a crushing head, a crushing head pivot point, a shaft, one or more pairs of adjacent bearings, a crushing chamber, crushing chamber liners, a working fluid, and an anti-spin system, said anti-spin system comprising:

(i) a working fluid source, said working fluid source being configured to supply the working fluid to the anti-spin system and the rock crusher;

(ii) a control valve, said control valve being in fluid communication with the working fluid source;

(iii) a torque transmittal assembly, said torque transmittal assembly being configured to transmit torque from the crushing head to the stationary frame and said torque transmittal assembly being disposed between the crushing head and the shaft, and said torque transmittal assembly having:

(A) a slider plate, said slider plate being disposed adjacent to the crushing head, and said slider plate having a tang;

(B) a torque adapter, said torque adapter being disposed adjacent to the slider plate;

(C) a radial piston motor, said radial piston motor being disposed adjacent to the torque adapter, and said radial piston motor being configured to provide working fluid flow to the anti-spin system;

wherein the anti-spin system is configured to control rotation of the crushing head; and wherein the control valve is configured to allow the working fluid to flow to the radial piston motor; and wherein the torque transmittal assembly is configured to connect the crushing head and the radial piston motor and;

(b) controlling the rotation of the crushing head.

* * * * *